United States Patent [19]

Podell et al.

[11] Patent Number: 4,977,382

[45] Date of Patent: Dec. 11, 1990

[54] VECTOR MODULATOR PHASE SHIFTER

[75] Inventors: Allen F. Podell, Palo Alto; Scott W. Mitchell; Sanjay B. Moghe, both of San Jose; Fazal Ali, Santa Clara, all of

[73] Assignee: Pacific Monolithics, Sunnyvale, Calif.

[21] Appl. No.: 235,664

[22] Filed: Aug. 23, 1988

[51] Int. Cl.[5] ..... H01P 1/165; H01P 1/18

[52] U.S. Cl. ..... 333/164; 333/81 R; 333/156; 333/157

[58] Field of Search ..... 333/156, 164, 157, 81 R

[56] References Cited

U.S. PATENT DOCUMENTS

| | | | |
|---|---|---|---|
| 4,398,161 | 8/1983 | Lamb et al. | 333/156 |
| 4,581,595 | 4/1986 | Siligi | 333/81 R X |
| 4,599,585 | 7/1986 | Vorhaus et al. | 333/164 |
| 4,605,912 | 8/1986 | Naster et al. | 333/164 |
| 4,638,269 | 1/1987 | Dawson et al. | 333/164 |

OTHER PUBLICATIONS

Naster et al.—"Affordable MMIC Designs for Phased Arrays", Microwave Journal, Mar. 1987; pp. 141–142 and 144–147.

Chen et al., "A GaAs Multi-Band Digitally-Controlled 0°–360° Phase Shifter", 1985 *GaAs IC Symposium Digest of Technical Papers,* IEEE, pp. 125–128.

Schindler et al., "Monolithic 6–18 GHz 3 Bit Phase Shifter", 1985 *GaAs IC Symposium Digest of Technical Papers,* IEEE, pp. 129–132.

Selin, "Continuously Variable L-Band Monolithic GaAs Phase Shifter", *Microwave Journal,* Sep. 1987, pp. 211–218.

Smith, "N-Bit L-Band Phase Shifters for Phased Arrays", 1983 *IEEE MTT-S Digest,* pp. 337–339.

*Primary Examiner*—Nelson Moskowitz
*Assistant Examiner*—Bernarr Earl Gregory
*Attorney, Agent, or Firm*—Edward B. Anderson

[57] ABSTRACT

A monolithic microwave integrated circuit (MMIC) phase shifter is implemented in push-pull configuration with the quadrant selection and vector modulation functions combined. These functions are provided by four sets of adjustable gate-width dual-gate FETs and a pair of lumped element filter networks with a relative differential phase shift of 90°.

24 Claims, 4 Drawing Sheets

VECTOR MODULATOR PHASE SHIFTER

FIELD OF THE INVENTION

The present invention relates to microwave phase shifters and more particularly to digitally controllable, wide bandwidth, high resolution phase shifters fabricable as monolithic microwave integrated circuits.

BACKGROUND OF THE INVENTION

Electronically scanned phased array antennas offer significant advantages over mechanically scanned antennas in scan speed and multiple beam formation. A typical antenna array consists of thousands of radiating elements. Each element in the array requires its own phase shifter to generate a desired radiation pattern.

Prior designs of phase shifters can be categorized as:

1. hybrid circuits with discrete diodes; and
2. monolithic circuits, including
   a. switched line/loaded line configuration circuits,
   b. quadrature couplers, and
   c. adjustable gate-width dual-gate FETs.

Previous phase shifter designs have used discrete diodes bonded into hybrid circuits. They are discussed in a general sense in Microwave Semiconductor Engineering by J. F. White, 1982, pp. 389–495. These circuits require labor-intensive assembly, and therefore a prohibitive manufacturing cost. Because of the thousands of phase shifters required in one phased array antenna, minimizing costs is an important criterion in phase shifter design. A phase shifter fabricated as a monolithic microwave integrated circuit (MMIC) offers cost reductions in batch processing and minimized assembly steps.

Some of the previous monolithic phase shifter designs use the switched line and the loaded line configurations. For the switched line phase shifter, gallium arsenide Field Effect Transistors (FETs) are used to switch the input microwave signal onto one of two transmission lines. The relative lengths of these lines produce a phase shift difference of some desired amount (180°, 90°, etc.). The loaded line phase shifter uses a transmission line with an FET in series with an inductor to ground on each side of the transmission line. This technique works only for phase shift values of 45° or less. Switched line and loaded line phase shift sections of these types are cascaded together to produce the desired phase resolution. A problem with both of these approaches is that they are limited to narrow bandwidths due to the use of transmission lines. Further, the phase error from the different sections is additive, causing undesired ripple.

A third type of design uses quadrature couplers with varactor diodes to ground on two ports, such as is described in U.S. Pat. No. 4,638,269. A control voltage varies the capacitance of the diode, which changes the phase of the signal reflected back into the coupler. Because this circuit produces a continuously variable phase shift, additional circuitry is required to generate analog control voltages. The drawbacks of this approach are reduced accuracy and decreased switching speed. In addition the full 0° to 360° range cannot be achieved.

A fourth existing phase shifter design (Y. K. Chen et al., "A GaAs Multi-Band Digitally-Controlled 0°–360° Phase Shifter," 1985 GaAs IC Symposium Digest of Technical Papers, p. 125–128) uses adjustable gate-width dual-gate FETs in a vector modulator to produce a phase shift from 0° to 90°. Separate sections are used to generate the 90° and 180° phase shifts necessary for four quadrant operation. Any deviation from 180° phase difference in the active phase splitter produces phase error. Subsequent circuit elements can do nothing to compensate for this deviation.

The desired phase shift quadrant (for example 180°–270°) is selected by controlling the voltages on the second gates of four FETs biased as amplifiers. Impedance mismatches will be present between the outputs of these switch FETs and the inputs of the attenuator FETs. These mismatches lead to gain and phase ripple in the frequency band. An alternate approach is to use passive FET switches, but this would increase the overall insertion loss of the circuit.

Another portion of this same phase shifter consists of the 90° phase shift networks. Each network is a resistor-capacitor circuit: one is a series combination; the other is a parallel combination. At the frequencies where a 90° phase difference can be obtained, the insertion loss is high.

A disadvantage of a dual-gate FET operated as a switched amplifier becomes evident at frequencies greater than 5 gHz, where the on-to-off ratio achieved by second gate switching is limited to 30 dB or less. This causes large errors in both phase and amplitude.

SUMMARY OF THE INVENTION

The present invention overcomes these disadvantages of the prior art in a wideband digitally-controllable phase shifter.

The present invention also provides a phase shifter that uses a reduced number of input connections, that can be fabricated monolithically, and that occupies a reduced amount of space on a gallium arsenide substrate in order to reduce manufacturing costs.

This invention also provides a phase shifter with high phase shift resolution (more bits), with good phase accuracy over a broad frequency band, and with low insertion loss and low VSWR.

The preferred phase shifter embodiment of this invention uses adjustable-gate-width dual-gate FET amplifier/attenuators to achieve a desired phase shift in specified increments from 0° to 360°. For example, a five bit phase shifter has phase increments of 11.25°; a six bit phase shifter has increments of 5.625°. There are no inherent limitations on the number of bits or the size of the phase increments.

A 180° phase split is preferably accomplished with a balun. The two resulting balanced (push-pull) signals are distributed throughout the symmetric circuitry of a chip containing the remainder of the phase shifter. The use of push-pull circuitry in attenuator pairs gives rise to common-mode rejection and causes the two signals to remain 180° out of phase. Therefore, the requirements on the accuracy of the 180° phase splitter are eased as compared to those for single-ended circuitry. The push-pull signal, due to a virtual ground, allows easy monolithic realization of the phase shifter without use of via holes.

The outputs of the four attenuator pairs in the preferred embodiment are fed to two balanced phase shift networks, whose differential phase shift is 90° over the desired bandwidth. Outputs from two of the attenuator pairs are fed to a band-pass or high-pass network that produces a +90° phase shift with respect to a low-pass or all-pass network fed by the other two attenuator pairs. The 90° networks consist of lumped elements for inductors and capacitors. These circuits have a lower insertion loss than resistor-capacitor networks used in the prior art, and can operate over a wider bandwidth than those using transmission lines. The four primary phase shifts (0°, 90°, 180°, and 270°) are generated by the appropriate choice of input and output connections to the 90° and 180° phase shift circuits.

The two pairs of push-pull attenuators provide a very high on-to-off ratio because the parasitic capacitances of one half of a push-pull pair are balanced by the similar parasitic capacitances of the other half. Operation from 4 to 18 gHz is practical with this circuit configuration.

To achieve five bit resolution, the phase shift is also varied within each quadrant. This is accomplished with a vector modulator, where the attenuator pairs for the vectors surrounding a particular quadrant are set to produce varying amounts of attenuation. The transconductance of a plurality of parallel-connected FETs, in which transconductance is proportional to the effective gate width, is digitally controlled with voltages on the gates of the FETs. Because the distinct functions of quadrant switching and vector modulator attenuation are combined into one set of FETs, the overall insertion loss and chip size are reduced. In addition, insertion loss for the phase shifter is low because the dual-gate FETs have gain to compensate for other circuit losses.

Variation of MMIC process parameters tends to occur from wafer to wafer. For circuits designed to minimize process sensitivity, a larger percentage of fabricated parts will meet performance specifications. Therefore process tolerant circuits have low manufacturing costs. The phase shift generated by the preferred embodiment of the present invention is primarily determined by a ratio of gate widths which are lithographically defined and exhibit few variations. This reduces process sensitivity. Because the voltages applied to the second gates are required only to be one of two distinct voltages, neither of which must be exact, precise analog voltage generating circuits are not necessary. These improvements make the circuit process tolerant and reduce manufacturing costs.

These and other features and advantages of the present invention will become apparent from a review of the following detailed description of the preferred embodiment and the associated drawings.

DETAILED DESCRIPTION OF THE PREFERRED EMBODIMENTS

Figure 1:
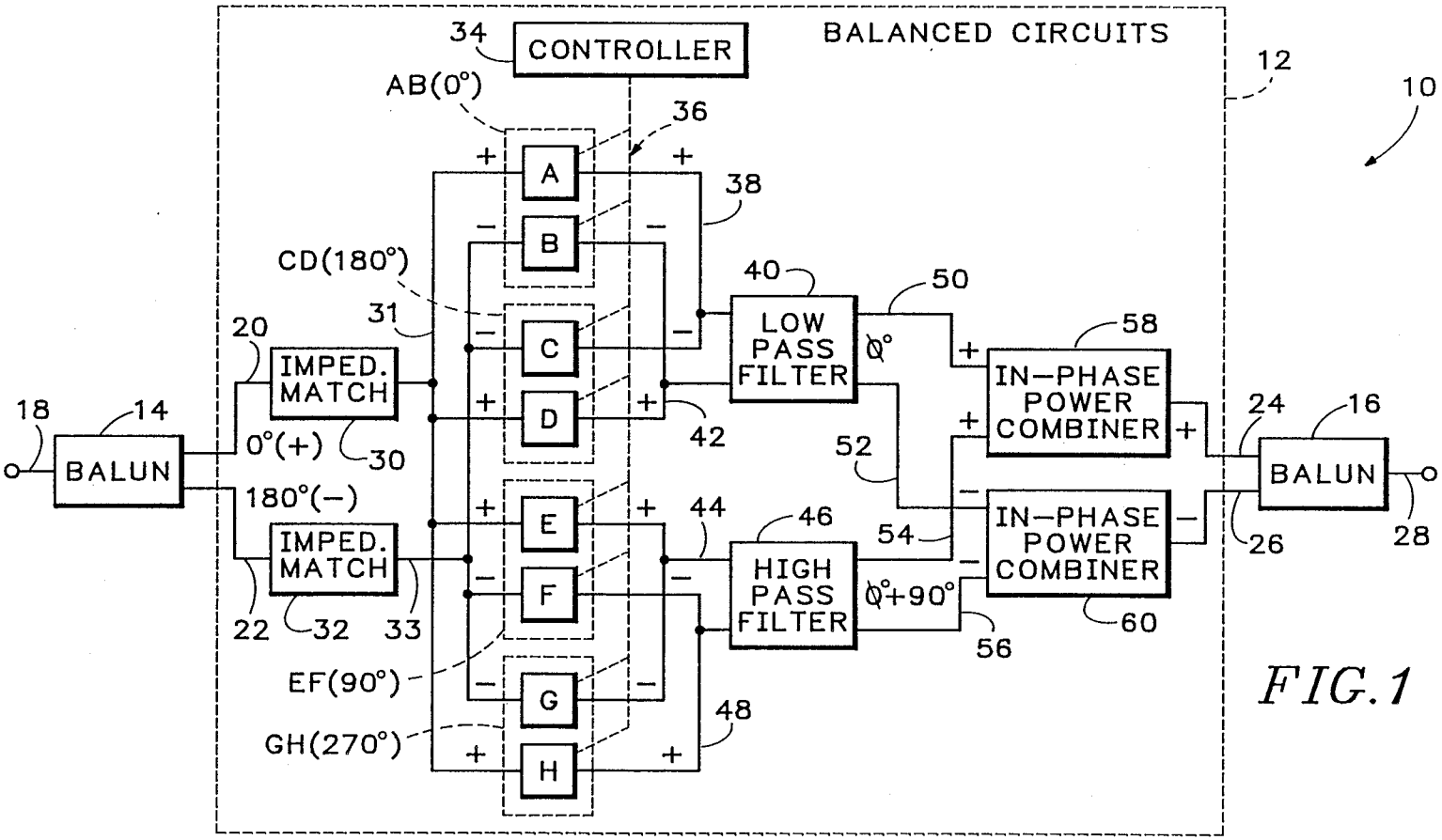
FIG. 1 is a block diagram of a phase shifter made according to the present invention.

Referring initially to FIG. 1, a block diagram of a phase shifter 10 made according to the present invention is shown.

The basic configuration of phase shifter 10 consists of a balanced circuitry 12 and input and output baluns 14 and 16, respectively. A gallium arsenide substrate with field effect transistors (FETs) and all necessary interconnecting circuit elements fabricated on the surface of the substrate, or chip, contains the balanced circuits. Baluns 14 and 16 are fabricated by depositing metal lines on an insulating substrate. Integration of the baluns onto the same substrate as circuitry 12 does not change the basic configuration.

The baluns are bi-directional devices that transform a single-ended, or unbalanced, signal into a pair of balanced signals, 180° out of phase with each other. The input microwave signal is applied to the single-ended port 18 of balun 14; the two balanced signals are then applied to the input ports 20 and 22 of circuitry 12 on the chip. The signals on the output ports 24 and 26 of the chip are applied to the balanced ports of balun 16; the signal from its single-ended port 28 is the output of the phase shifter.

The balanced signals (0° and 180°) from balun 14 are applied to impedance-matching circuits 30 and 32, respectively, formed of inductors and capacitors on the monolithic chip to match the impedances to 50 ohms.

The 0° signal output from circuit 30 is fed via conductor 31 to amplifier/attenuators A, D, E and H. The 180° signal is fed via conductor 33 to amplifier/attenuators B, C, F and G. These attenuators are connected as attenuator pairs labelled AB, CD, EF and GH. Each attenuator pair is connected in the push-pull configuration and can be referred to by the phase shift it produces when it is turned "on" and the others are "off": AB is 0°, EF is 90°, CD is 180° and GH is 270°. The effect of this interconnection is to feed the 0° (AB) and 90° (EF) attenuator pairs with the input signal shifted by 0°, and to feed the 180° (CD) and 270° (GH) pairs with the input signal shifted by 180°. The attenuator pair operation is controlled by a controller 34 which outputs control signals on conductors identified generally at 36.

The outputs of attenuators A and C are joined by a conductor 38 and coupled to one of two balanced inputs of a low pass filter 40. The outputs of attenuators B and D are joined by a conductor 42 and coupled to the other balanced input of filter 40. Similarly the outputs of attenuators E and G are joined by a conductor 44 and coupled to one of two balanced inputs of a high pass filter 46. The other balanced input to filter 46 is coupled from the outputs of attenuators F and H on a conductor 48. There is a 90° differential phase shift over the desired bandwidth between filters 40 and 46.

The balanced outputs of the filter networks are on conductors 50, 52, 54 and 56. Conductors 50 and 54 are connected to the inputs of a first in-phase power combiner 58. A second in-phase power combiner 60 is fed by conductors 52 and 56. The outputs from these two power combiners are fed off the monolithic chip on conductors 24 and 26 to balun 16.

Figure 2:
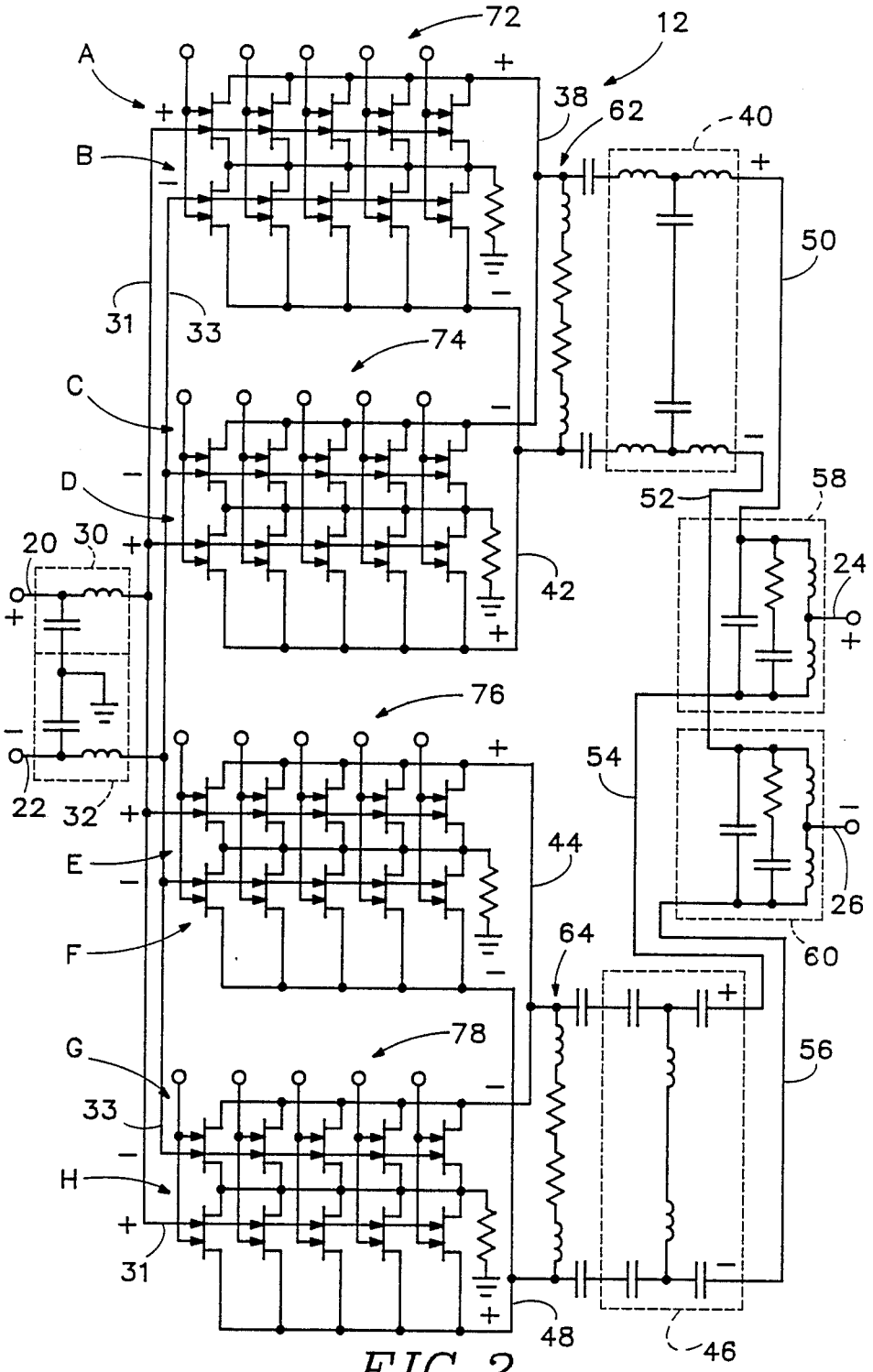
FIG. 2 is circuit schematic of a first preferred embodiment of the balanced circuitry of the phase shifter of FIG. 1.

Referring now to FIG. 2, a schematic of circuitry 12 is shown in further detail. Each attenuator pair, such as pair AB, consists in this embodiment of two sets of five dual-gate FETs of varying widths. The sources, drains, and first gates within each attenuator are connected to each other, as shown.

The sources of the FETs in each attenuator pair are connected together and to a resistor to ground. The combined drains of attenuators A and C, and of attenuators B and D are connected to an impedance matching network 62, to a bias supply network (not shown), and then to the balanced inputs of low-pass filter 40. The combined drains of attenuators E and G, and of attenuators F and H are connected to an impedance matching network 64 and a bias supply network (not shown) and then to the balanced inputs of high-pass filter 46.

The terminal voltages of an attenuator that is said to be "on" are such that DC current flows from drain to source, and the attenuator has gain or a small insertion loss at microwave frequencies. An attenuator that is "off" draws no DC current and has a very high insertion loss at microwave frequencies.

The levels of attenuation in the attenuators that are "on" are controlled to ensure that the magnitude of the sum of the two generated vectors remains constant for all phase states.

Figure 4:
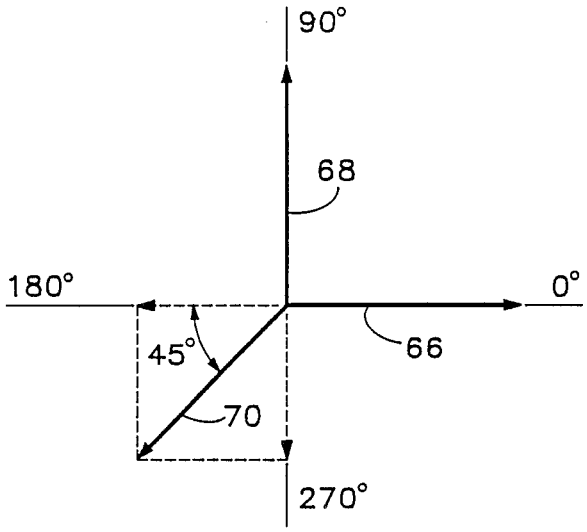
FIG. 4 is a vector diagram illustrating formation of an output signal by combining input signals that have selected relative orthogonal phases.

FIG. 4 illustrates how vectors are combined to produce a resultant output of a desired phase. For instance a vector 66 having a 0° phase angle is generated by having only selected ones of the FETs in attenuator pair AB on. A vector 68 having a 90° phase angle is generated by having only selected FETs of attenuator pair EF on. A resultant vector 70 having a 225° phase angle is generated by having appropriate ones of the FETs of attenuator pair CD (phase angle of 180°) and attenuator pair GH (phase angle of 270°) on.

Referring again to FIG. 2, four control signals are carried by corresponding sets 72, 74, 76 and 78 of control lines which provide the relative vector magnitude determination for each of the four primary phase signals. Each set includes five control lines for this preferred embodiment. As used herein, a general signal may be comprised of a plurality of specific signals, such as a control signal comprising a separate signal on each control line. The signals forming each of the control signals in turn result in an output signal having the desired phase. One vector is attenuated in proportion to the sine of the desired angle, and the second vector is attenuated in proportion to the cosine. The second gates of an attenuator pair are used to switch sections of gate width "on" and "off". The relative widths of the different FET sections and the scheme for determining which of the FETs to turn "on" and "off" are chosen to generate appropriate vectors for maintaining an output signal with a constant magnitude.

In the embodiment of the invention shown in FIG. 2, only two voltage levels from controller 34 (FIG. 1) are required. The first gates of all the attenuator pairs are biased to the same voltage by biasing networks not shown. The quadrant of the phase shift is selected by turning only selected ones of the second gates of the appropriate attenuator pairs "on".

Figure 3:
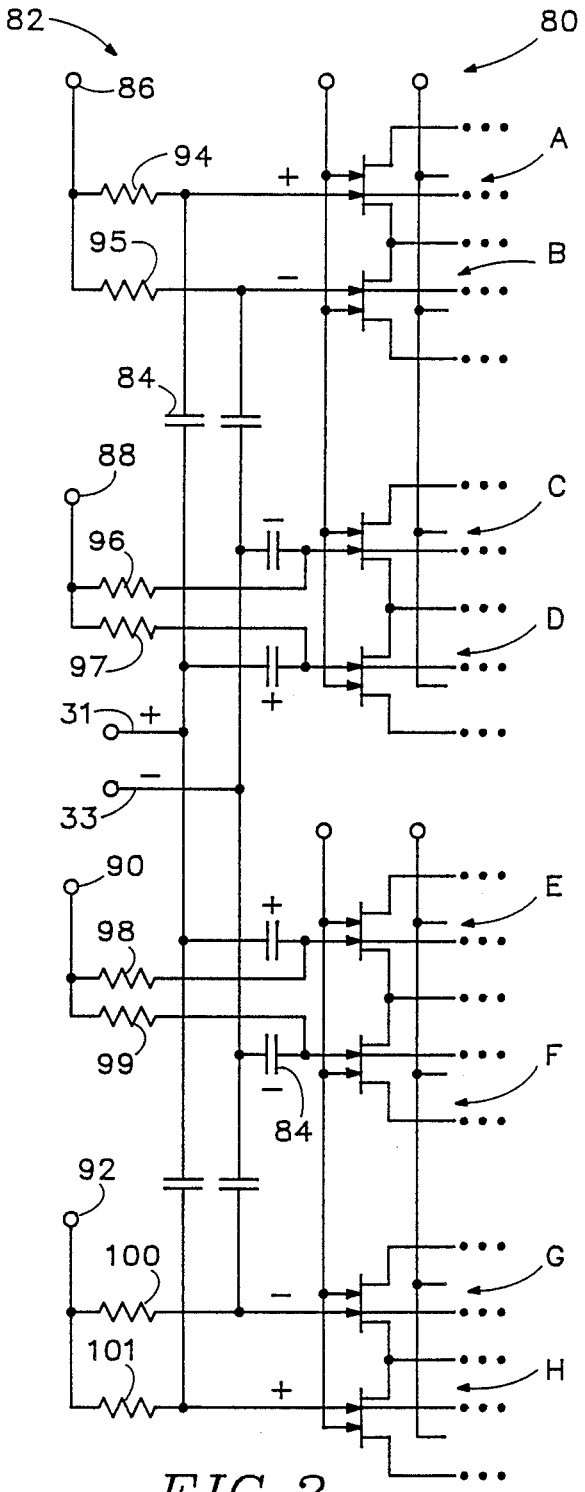
FIG. 3 is a partial schematic similar to a portion of FIG. 2 showing a second preferred embodiment.

A second preferred embodiment of the invention is shown in FIG. 3. In this embodiment, a phase shifter 80 is made the same as phase shifter 10 except for the control and biasing of the FETs associated with attenuators A, B, C, D, E, F, G and H. In this embodiment the function of the second gate switching of the bank of bits in each attenuator as provided by phase shifter 10, is performed by the first gates instead. DC biasing voltages, as applied by conductors 86–92 on the first gates are used to turn a complete attenuator pair "on" and "off", thus selecting the quadrant of the phase shift. These voltages are applied through high value resistors 94–101.

Only two attenuator pairs will be turned "on" at any given time. In addition, the 0° and 180° pairs (AB and CD) will never be turned "on" simultaneously, and also the 90° and 270° pairs (EF and GH) will never be "on" together. Therefore, each second gate for the 0° pair AB is connected to the corresponding second gate for the 180° pair CD and receives what may be considered an actuating control signal. The second gates of the 90° and 270° pairs EF and GH are connected similarly. This reduces the total number of control lines required to operate the phase shifter to 14 as compared to 20 for phase shifter 10.

When the first gate of a dual-gate FET is used to turn the FET "off", i.e. its voltage with respect to the source is made negative so that no DC current flows, the input capacitance from the first gate to the source decreases. This capacitance is typically the bandwidth limiting factor in an amplifier of this type. The input gate-source capacitance is nearly proportional to the effective gate width that is turned "on", allowing the approach of this phase shifter 80 to have nearly two times the gain-bandwidth product of the alternate approach incorporated in phase shifter 10, where only the second gates are used to turn the FETs "off".

The integration of digital circuitry to decode from the N-bit control input (where N is determined by the specified phase shift resolution) to gate voltages reduces the number of input connections and assembly steps, thereby reducing the cost.

Referring again to FIG. 2, both filters 40 and 46 are designed in a push-pull configuration. The low-pass network of filter 40 consists of four series inductors, two for each side, and two shunt capacitors, each of which are connected on one side to the point between the inductors and to each other on the other side. The high-pass network of filter 46 consists of four series capacitors, two for each side, and two shunt inductors, each of which is connected on one side to the point between the capacitors and to each other on the other side. A lattice network could have been substituted for either or both of networks 40 and 46.

Both in-phase power combiners 58 and 60 have the same component structure. More specifically, for each one, a capacitor and a resistor/capacitor series combination are connected in parallel between the respective inputs from filters 40 and 46. These inputs are also respectively coupled to the outputs through inductors, as shown in FIG. 2.

This phase shifter approach can be used for any number of bits from 2 or higher, even though FIG. 2 shows the configuration for 5 bits. As the number of bits changes so does the number of FETs in attenuators A, B, etc. Similarly, the approach can be used for narrow band or wide band applications depending on the bandwidth of the filter networks used.

The preferred embodiments of the present invention provide an MMIC phase shifter operable over a wide frequency band and implemented in push-pull configuration with the quadrant selection and vector modulation functions combined into one set of adjustable gate-width dual-gate FETs. A pair of lumped element filter networks provide a relative differential phase shift of 90°. Although the invention has been described with reference to the foregoing preferred embodiments, it will be apparent to one skilled in the art that other variations in form and design can be made without parting from the spirit and scope of the invention as defined in the claims.

We claim:

1. A phase shifter for shifting the phase of an input signal by a predetermined amount comprising:

first level adjusting means coupled to receive the input signal and responsive to a first control signal for adjusting the level of the input signal by a first predetermined amount determined by the first control signal;

second level adjusting means coupled to receive the input signal and responsive to a second control signal for adjusting the level of the input signal by a second predetermined amount determined by the second control signal;

means coupled to said second level adjusting means for receiving the associated level-adjusted signal and shifting the phase of the associated level-adjusted signal by 90°;

control means for generating the first and second control signals appropriate for producing the output signal with the predetermined phase when the signals are combined; and means for combining the input signal the level of which has been adjusted by said first level adjusting means with the 90°-phase shifted input signal the level of which has been adjusted by said second level adjusting means to produce an output signal the phase of which is shifted from the phase of the input signal by the predetermined amount.

2. A phase shifter according to claim 1 wherein each of said level adjusting means comprises field effect transistor (FET) means, and said control means generates, for each control signal, a biasing signal for biasing the D.C. level of the signal input to each of said FET means, and an actuating signal which when applied with the biasing signal to said FET means selectively turns on said FET means.

3. A phase shifter for shifting the phase of an input signal by a predetermined amount comprising:

first level adjusting means coupled to receive the input signal and responsive to a first control signal for adjusting the level of the input signal by a first predetermined amount determined by the first control signal;

means for shifting the phase of the input signal by 180°;

second level adjusting means coupled to receive the 180°-phase shifted input signal and responsive to a second control signal for adjusting the level of the 180°-phase shifted input signal by a second predetermined amount determined by the second control signal;

third level adjusting means coupled to receive the input signal and responsive to a third control signal for adjusting the level of the input signal by a third predetermined amount determined by the third control signal;

fourth level adjusting means coupled to receive the 180°-phase shifted input signal and responsive to a fourth control signal for adjusting the level of the 180°-phase shifted input signal by a fourth predetermined amount determined by the fourth control signal;

means coupled to said third level adjusting means and said fourth level adjusting means for shifting the phases of the associated signals 90°;

control means for generating the first, second, third and fourth control signals appropriate for producing the desired phase of the output signal when the signals are combined; and means for combining the input signals the levels of which have been adjusted by said first and second level adjusting means with the 90°-phase shifted input signals, the levels of which have been adjusted by said third and fourth level adjusting means, to produce an output signal the phase of which is shifted from the phase of the input signal by the predetermined amount.

4. A phase shifter according to claim 3 wherein each of said level adjusting means comprises a plurality of field effect transistor (FET) means, and said respective control signal selectively turns each of said FET means within said level adjusting means on and off for adjusting the signal level according to the cumulative conduction provided by said plurality of FET means.

5. A phase shifter according to claim 4 wherein said control means generates, for each control signal, a biasing signal for biasing the D.C. level of the signal input to each of said FET means, and an actuating signal which when applied with the biasing signal to said corresponding FET means selectively turns on said FET means.

6. A phase shifter according to claim 5 wherein a first actuating signal is applied to both said first and second level adjusting means and a second actuating signal is applied to both said third and fourth level adjusting means.

7. A phase shifter according to claim 5, wherein said control means generates a biasing signal for each level adjusting means for biasing on and off each FET means.

8. A phase shifter according to claim 7 wherein a first biasing signal is applied to both first and second level adjusting means and a second biasing signal is applied to both third and fourth level adjusting means.

9. A phase shifter according to claim 7 wherein a different biasing signal is applied to each of said four level adjusting means.

10. A phase shifter according to claim 9 wherein only one of said first and second level adjusting means and only one of said third and fourth level adjusting means are turned on at a time.

11. A phase shifter according to claim 3 further comprising fifth, sixth, seventh and eighth level adjusting means, responsive to respective control signals for adjusting the levels of the associated signals, with said fifth and seventh level adjusting means being coupled to receive the 180°-phase shifted input signal and the sixth and eighth level adjusting means being coupled to receive the input signal without 180° phase adjustment, wherein said 90°-phase shifting means is also coupled to said seventh level adjusting means and said eighth level adjusting means for shifting the phases of the associated signals 90°, and said combining means combines all of the respective level adjusted and phase shifted input signals to produce the output signal.

12. A phase shifter according to claim 11 wherein the outputs of said first and second level adjusting means, third and fourth level adjusting means, fifth and sixth level adjusting means, and seventh and eighth level adjusting means, respectively, are coupled together.

13. A phase shifter according to claim 11 wherein each of said level adjusting means comprises a plurality of field effect transistor (FET) means and said control signals selectively turn each of said FET means on and off.

14. A phase shifter according to claim 13 wherein said control means generates, for each control signal, a biasing signal for biasing the D.C. level of the signal input to each of said FET means, and an actuating signal which when combined with the biasing signal selectively turns on said FET means.

15. A phase shifter according to claim 14 wherein a first actuating signal is applied to each of said first, second, fifth and sixth level adjusting means and a second actuating signal is applied to each of said third, fourth, seventh and eighth level adjusting means.

16. A phase shifter according to claim 14 wherein said control means generates a biasing signal for each level adjusting means for biasing on and off each associated FET means.

17. A phase shifter according to claim 16 wherein first, second, third and fourth biasing signals are applied to both first and fifth, to both second and sixth, to both third and seventh, and to both fourth and eighth level adjusting means, respectively.

18. A phase shifter according to claim 11 wherein only one of said first and second level adjusting means, only one of said third and fourth level adjusting means, only one of said fifth and sixth level adjusting means, and only one of said seventh and eighth level adjusting means are turned on at a time.

19. A phase shifter according to claim 18 wherein only two of said first, second, fifth and sixth level adjusting means, and only two of said third, fourth, seventh and eighth level adjusting means are turned on at a time.

20. A phase shifter according to claim 11 wherein said means for combining further includes combining the outputs of said first, second, third and fourth level adjusting means into a first intermediate signal that is in phase with the output signals, and combining the outputs of said fifth, sixth, seventh and eighth level adjusting means into a second intermediate signal having a phase equal to the phase of the first intermediate signal plus 180°.

21. A phase shifter according to claim 20 wherein said means for combining further combines said first and second intermediate signals into the output signal having the predetermined phase.

22. A phase shifter according to claim 21 wherein said eight level adjusting means, said 90° phase shifting means and said combining means are formed as balanced networks having separate signals 180° out of phase with each other.

23. A phase shifter according to claim 11 wherein the respective fifth, sixth, seventh and eighth control signals are the same as the first, second, third and fourth control signals, respectively.

24. A phase shifter according to claim 3 wherein the outputs of said first and second level adjusting means, and said third and fourth level adjusting means, respectively, are coupled together.

* * * * *